US005899623A

United States Patent [19]

de Laforcade

[11] Patent Number: 5,899,623

[45] Date of Patent: May 4, 1999

[54] DEVICE FOR DISPENSING A SUBSTANCE STORED UNDER PRESSURE

[75] Inventor: Vincent de Laforcade, Rambouillet, France

[73] Assignee: L'Oreal, Paris, France

[21] Appl. No.: 08/672,712

[22] Filed: Jun. 28, 1996

[30] Foreign Application Priority Data

Jul. 13, 1995 [FR] France ..... 95 08521

[51] Int. Cl.[6] ..... A45D 34/00

[52] U.S. Cl. ..... 401/190; 222/402.13; 401/202

[58] Field of Search ..... 401/190, 202; 222/402.13

[56] References Cited

U.S. PATENT DOCUMENTS

| | | | |
|---|---|---|---|
| 2,981,446 | 4/1961 | Campbell . | |
| 3,934,761 | 1/1976 | Gentreau | 222/402.13 |
| 3,981,597 | 9/1976 | Cohn | 401/190 |
| 4,277,004 | 7/1981 | Barlics | 222/402.13 |
| 5,139,201 | 8/1992 | De Laforcade . | |

FOREIGN PATENT DOCUMENTS

| | | | |
|---|---|---|---|
| 669203 | 12/1965 | Belgium . | |
| A-0 037 903 | 10/1981 | European Pat. Off. . | |
| 455552 | 11/1991 | European Pat. Off. | 401/190 |
| A-0 526 298 | 2/1993 | European Pat. Off. . | |
| 1512794 | 2/1968 | France . | |
| A-1 562 239 | 4/1969 | France . | |
| A-2 571 312 | 4/1986 | France . | |
| 2640942 | 6/1990 | France | 222/402.13 |
| 2713060 | 6/1995 | France | 401/190 |
| 1750025 | 5/1978 | Germany | 222/402.13 |
| A-2 108 205 | 5/1983 | United Kingdom . | |

*Primary Examiner*—Steven A. Bratlie
*Attorney, Agent, or Firm*—Oliff & Berridge, PLC

[57] ABSTRACT

A device for dispensing a substance stored under pressure in a receptacle, the device including a cover for snapping on the receptacle, the receptacle being provided with a valve having a control rod, the cover including a tubular endpiece for engaging on the control rod and co-operating therewith to form a channel along which the substance passes. The cover includes at least one bearing surface disposed outside the endpiece and suitable for preventing the control rod from occupying the annular space around the outside of the endpiece in order to prevent the cover being snapped into place while the control rod is in an inclined position.

9 Claims, 5 Drawing Sheets

DEVICE FOR DISPENSING A SUBSTANCE STORED UNDER PRESSURE

The present invention relates to a device for dispensing a substance stored under pressure in a receptacle provided with a valve having a control rod, and particularly but not exclusively a valve that is opened by applying lateral thrust to a tiltable control rod, and more precisely a device of the type comprising a cover for snap-fastening on the receptacle and provided with a tubular endpiece for engaging on the control rod so as to co-operate therewith to form a channel for delivering the substance.

BACKGROUND OF THE INVENTION

In known dispensing devices, the annular space around the outside of the cover endpiece is empty of material for the sake of economy, and until now, covers have been put into place by means of machines that are required to maintain very accurate alignment of the endpiece and the control rod prior to the cover being snapped into place in order to avoid any risk of fixing the cover with the control rod not being engaged in the endpiece, but extending obliquely outside the endpiece in the above-mentioned annular space, it being of great importance to avoid such a situation since it can lead to the control rod being broken or to the receptacle being emptied.

European patent application No. 0 037 903 discloses a device for dispensing a substance stored under pressure in a receptacle, and including a cover for snapping onto the receptacle. The receptacle has a control rod valve which is opened by applying axial thrust to the control rod. The control rod is fixed on the body of the receptacle by means of a cup. The device includes an endpiece for engaging on the control rod and co-operating therewith to form a channel for delivering the substance. The bottom of this endpiece has a cylindrical portion that slides on a projection formed in the center of the cup. The endpiece can be lowered onto the control rod only if the bottom cylindrical portion of the endpiece has previously been engaged on the projection of the cup. Not only does such a device require a special shape of cup carrying the control rod, it is also applicable solely to a receptacle provided with a control rod which opens when subjected to axial thrust.

OBJECTS AND SUMMARY OF THE INVENTION

An object of the present invention is to provide a novel device in which cover mounting is made easier and can be performed quite safely, even by an inexperienced operator.

The invention achieves this object by the fact that the cover includes at least one bearing surface disposed outside the endpiece and suitable for preventing the control rod occupying the annular space around the outside of the endpiece, for the purpose of preventing the cover from being snapped into place when the control rod is in an inclined position.

By means of the invention, it is possible to use machines that are less accurate and therefore cheaper for the purpose of mounting covers on receptacles, since the possibility of the cover being snapped into place with the control rod not received in the endpiece has been eliminated.

It has been observed that the extra cost due to the presence of material in the annular space around the outside of the endpiece is, in the long run, more than compensated by the productivity gain provided by the invention.

Also, in the event of a user accidentally removing the cover, it is easy for the user to put the cover back into place without any risk of it snap-fastening with the control rod not received in the endpiece.

In a particular embodiment of the invention, said bearing surface is implemented by means of a part added to the endpiece and suitable for preventing the control rod from occupying the annular region surrounding the outside of the endpiece.

In another particular embodiment of the invention, the cover includes a plurality of bearing surfaces in the form of fins extending radially outwards from the endpiece.

Advantageously, each bearing surface forms a guide structure for guiding the control rod towards the endpiece.

The invention also provides a receptacle fitted with a dispenser device as specified above.

BRIEF DESCRIPTION OF THE DRAWINGS

Other characteristics and advantages of the present invention appear on reading the following detailed description of three non-limiting embodiments of the invention and on examining the accompanying drawings, in which.

MORE DETAILED DESCRIPTION

Figure 1:
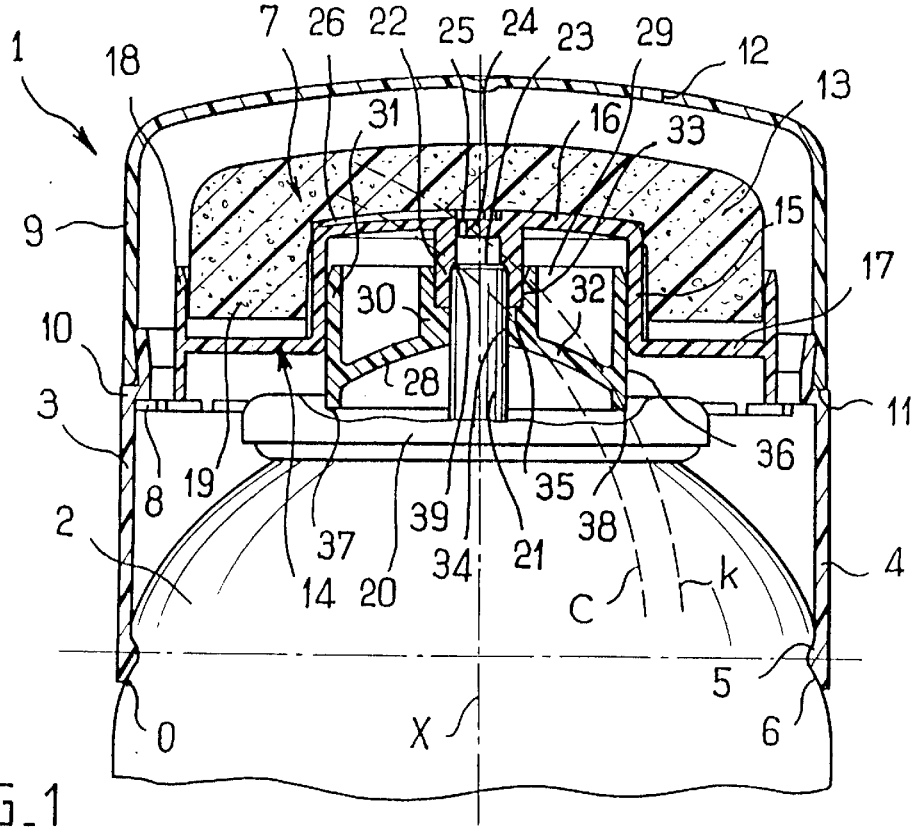
FIG. 1 is a diagrammatic axial section view of a receptacle fitted with a cover and constituting a first embodiment of the invention.

FIG. 1 shows a device 1 of the invention used for dispensing a substance such as a deodorant which is stored under pressure in a conventional receptacle 2 of the aerosol can type.

The device 1 includes a cover 3 provided in conventional manner at the bottom with a tubular skirt 4 that is generally circularly symmetrical about an axis X lying in the section plane of FIG. 1, and having an annular swelling 5 at its base that projects radially inwards for snap-fastening in an annular groove 6 formed in the dome-shaped top portion of the receptacle.

The top portion of the cover 3 includes a movable applicator 7 for dispensing the substance, which applicator is connected to the tubular skirt 4 by a flexible link that is constituted in the example shown by a ring 8 that is perforated to form a plurality of flexible tongues.

When the device 1 is not in use, the applicator 7 can be protected by a lid 9 for engaging on the top end of the tubular skirt 4. The lid 9 is held to the tubular skirt 4 by friction or by snap-fastening, and when it is in position on the cover 3, it has its bottom edge 11 in end abutment on an outer shoulder formed by a step 10 in the tubular skirt 4. The lid 9 has an air vent 12 passing through its top portion, and its lateral outside surface is situated flush with the outside surface of the tubular skirt 4 when the lid is in place thereon.

The applicator 7 includes an applicator member 13 which is intended in the example described to come into contact with the skin and which is constituted by a pad that is porous and not very deformable, being obtained by sintering, and that is fixed on a supporting portion 14. The supporting portion comprises a tubular central wall 15 about the axis X which is connected at its top to a transverse wall 16 that bulges slightly upwards, and that is extended at its bottom by a plane annular wall 17 perpendicular to the axis X.

The periphery of the annular wall 17 is connected to a tubular wall 18 about the axis X, meeting it about halfway up. The tubular walls 15 and 18 are coaxial and between them they define an upwardly open annular groove 19 with the bottom of the groove being formed by the annular wall 17. In axial section in a section plane containing the axis X, the applicator member 13 is in the form of an upside-down U-shape with the branches thereof being engaged in the annular groove 19 and uniting to cover the transverse wall 16.

The tubular wall 18 is connected to the tubular skirt 4 by the above-mentioned ring 8. At rest, the ring extends perpendicularly to the axis X and its radially outer edge is fixed on an internal shoulder formed by the step 10 and by its radially inner edge on the bottom end edge surface of the tubular wall 18.

At its top end, the receptacle 2 is provided with a valve cup 20 crimped in an opening of the receptacle and having an inclinable control rod 21 passing through its center. Opening and closing of the valve integrated in the receptacle depends on the orientation of the inclinable control rod, in a manner known per se, with such a device sometimes being referred to as a lateral deformation valve. The portion of the control rod 21 situated outside the receptacle is circularly cylindrical about an axis that coincides with the axis X when the rod is at rest, with the valve in its closed position, and it is tightly received in an endpiece 22 secured to the support portion 14. It has an outlet channel for the substance to be dispensed passing axially therealong and opening out in its top end 23. The control rod 21 causes the valve to open whenever it is tilted into a position that is oblique relative to the axis X by means of a force applied to the flank thereof transversely relative to the axis X, e.g. due to the applicator member 13 being moved in contact with the skin of the user, thereby deforming the ring 8.

The top end of the endpiece 22 couples to the transverse wall 16 and it has an internal step for defining a maximum penetration position of the control rod 21. The top wall 24 of the endpiece 22 has a jet-breaking orifice 25 passing therethrough so as to make it possible for the substance that is to be dispensed to escape. The top surface of the transverse wall 16 is grooved radially in known manner at 26 so as to distribute the substance leaving the orifice 25 over the inside face of the applicator member 13, thereby distributing the substance uniformly.

A part 28 is put in the annular groove 29 formed between the endpiece 22 and the tubular wall 15. This part 28 may be fixed by any means known to the person skilled in the art, e.g. by snap-fastening, and it has two coaxial walls 30 and 31 that are united at their bottom ends by a web 32 that is convex towards the receptacle 2. The radially inner wall 30 is internally stepped, having two circularly cylindrical surfaces 33 and 34 about an axis of symmetry that coincides with the axis X when the control rod is at rest, which surfaces are united by a shoulder 35 extending perpendicularly to said axis of symmetry. The surface 33 bears against the radially outer surface of the endpiece 22 and the shoulder 35 comes into contact with the bottom end edge thereof. The surface 34 extends the inside surface of the endpiece 22 downwards in contact with the control rod 21. The top portion of the wall 31 has its radially outer surface 26 bearing against the tubular wall 15 and the bottom portion thereof extends beyond the annular wall 17, as shown in FIG. 1. Reference 37 designates the bottom end edge of the wall 31. The web 32 is at an angle of about 78° relative to the axis X in the vicinity of its radially inner edge. The person skilled in the art will observe that the shape of the part 28 is easy to mold in a plastics material such as polypropylene and that the bottom portion of the endpiece 22 in which the control rod 21 is inserted is itself likewise easy to mold since it does not have any undercuts.

When the cover 3 is in place on the receptacle 2, the bottom edge of the annular swelling 5 extends around a circle centered on the axis X. One of the two points of intersection between said circle and the section plane of FIG. 1 is referenced O. Reference K designates a greater diameter circular arc having O as its center and intersecting the edge 38 formed by the junction between the bottom end edge 37 and the surface 36. A smaller diameter circle on center O that intersects the edge 39 formed by the junction between the outer cylindrical surface of the control rod 21 and its top end edge 23 is referenced C. In FIG. 1, it will be observed that the radius of circle K is greater than the radius of circle C such that rotation of the cover 3 about an axis of rotation passing through the point O and perpendicular to the plane of the section of FIG. 1 does not run any risk of fixing the cover 3 with the control rod 21 not engaged in the endpiece 22, as explained more fully below.

Figure 2:
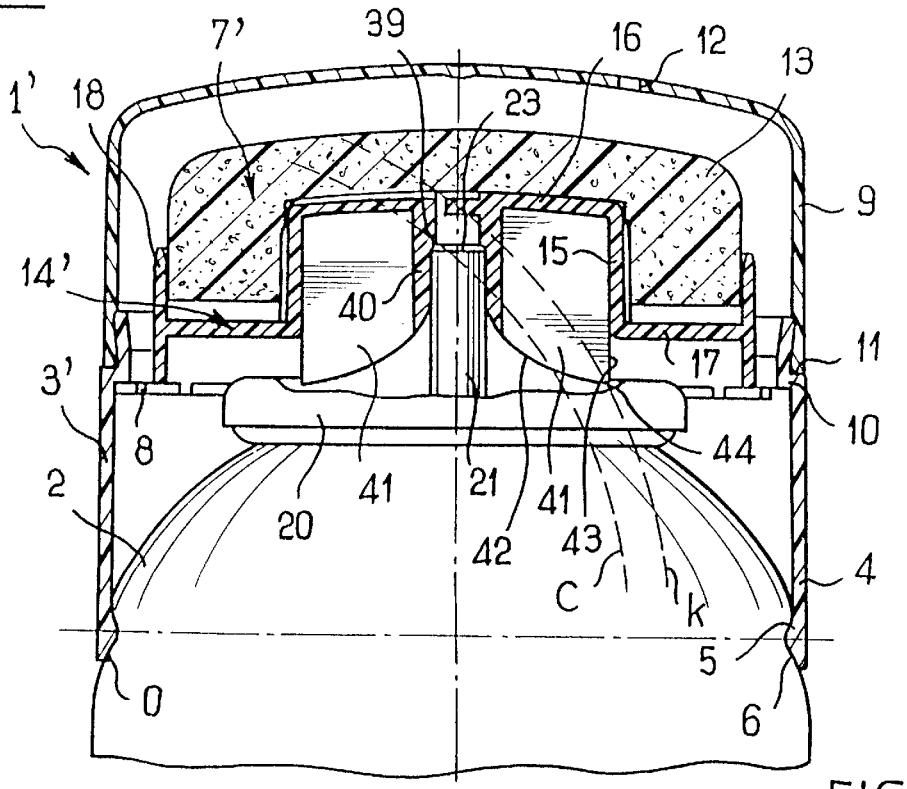
FIG. 2 is a diagrammatic axial section view of a receptacle fitted with a cover and constituting a second embodiment of the invention.
Figure 3:
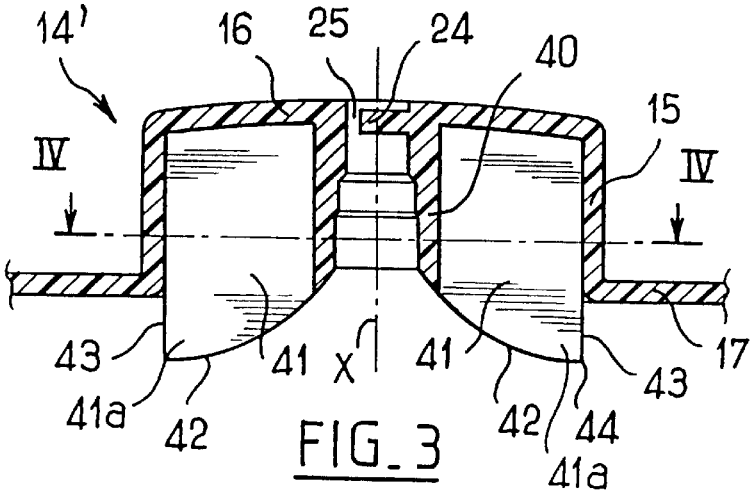
FIG. 3 shows the endpiece of the FIG. 2 cover on its own.
Figure 4:
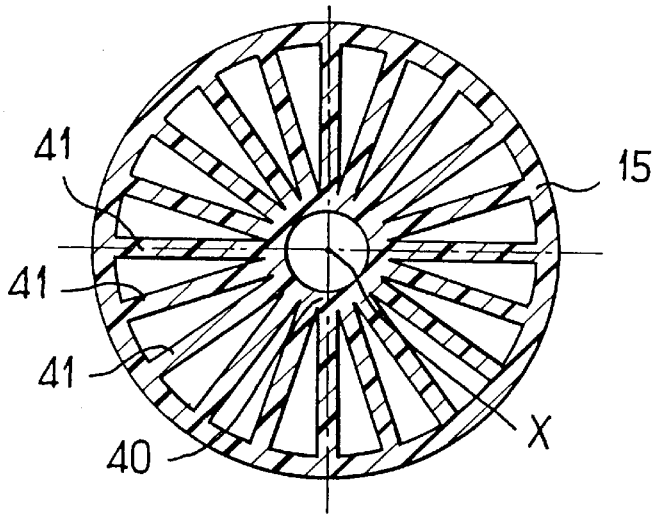
FIG. 4 is a section on section line IV—IV of FIG. 3.

FIGS. 2 to 4 show a dispenser device 1' constituting a second embodiment of the invention.

In the description below, items that are identical to those of the preceding embodiment are given the same reference numerals, and consequently they do not need to be described in detail again.

The device 1' differs mainly from the preceding device in the support portion 14' for the applicator member 13. The top end of the control rod 21 is engaged in an endpiece 40 that forms an integral portion of the support portion 14' which is longer than the above-described endpiece 22 and is extended radially outwards by fins 41 replacing the add-on part 28 in the preceding embodiment. The fins 41 are integral with the endpiece 40 and they are disposed in a star configuration thereabout, as can be seen in FIG. 4. In the example described, the endpiece 40 is surrounded by twenty fins 41 uniformly spaced apart around the axis X at 18° intervals.

The thickness and the angular spacing of the fins 41 are selected in such a manner as to make it impossible for the control rod 21 to become jammed between two adjacent fins, thus preventing it from occupying any position in the annular space situated between the endpiece 40 and the tubular wall 15.

In a section plane containing the axis X, the bottom free edge 42 of each fin 41 is rounded in shape, being convex towards the outside (as shown in FIG. 3), and together the fins 41 constitute a structure for guiding the control rod 21 and converging on the endpiece 40. The inside of the endpiece is chamfered to form a conical mouth sloping at about 35° relative to the axis X. Each fin 41 extends radially between the endpiece 40 and the wall 15, and its radially outermost bottom end 41*a* projects below the annular wall 17, as can be seen in FIG. 3. The radially outer surface of the bottom portion of each fin 41 is referenced 43, and the edge defined at the junction between an edge 42 and the surface 43 is referenced 44.

On examining FIG. 2, it will be observed that the circle K of center O and of greater diameter containing an edge 44 is of radius greater than that of the circle C.

Figure 5:
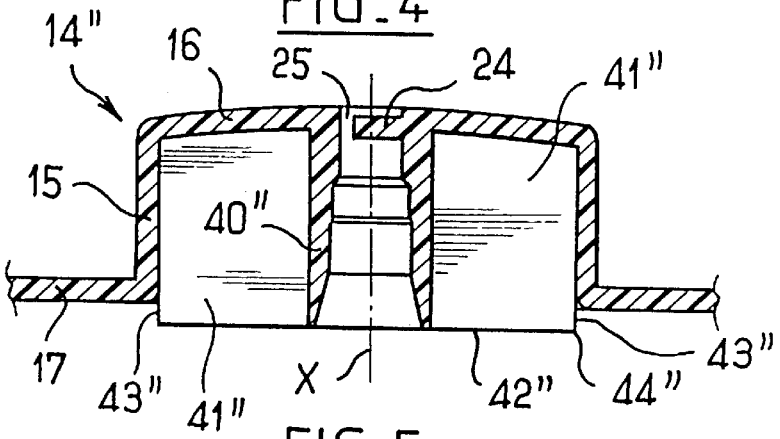
FIG. 5 is a view analogous to FIG. 3 showing the endpiece of a cover constituting a third embodiment of the invention.

FIG. 5 shows a variant 14" of the above-described supporting portion 14'.

This embodiment differs from the preceding embodiment by the shape of the endpiece 40" and the shape of the fins 41". The fins have a bottom free edge 42" that is not rounded as in the preceding embodiment, but that is plane and perpendicular to the axis X. The endpiece 40" extends axially over the full height of the fins 41" and it is internally chamfered at its bottom end to define a conical surface for centering the control rod 21 while the cover is being put into place, which chamfered surface is at an angle of about 15° relative to the axis X.

Reference 43" designates the radially outermost surfaces of the fins 41" which project below the annular wall 17, and reference 44" designates each of the edges defined where said lateral surface 43" meets an edge 42".

The height of the fins 41" is selected so that the larger diameter circle K on center O containing an edge 44" includes the circle C as defined above.

There follows a description of how the device 1' described with reference to FIGS. 2 to 4 is put into place on a receptacle 2. Naturally, the way in which the devices comprising the various embodiments of FIGS. 1 and 5 are put into place is similar.

Figure 6:
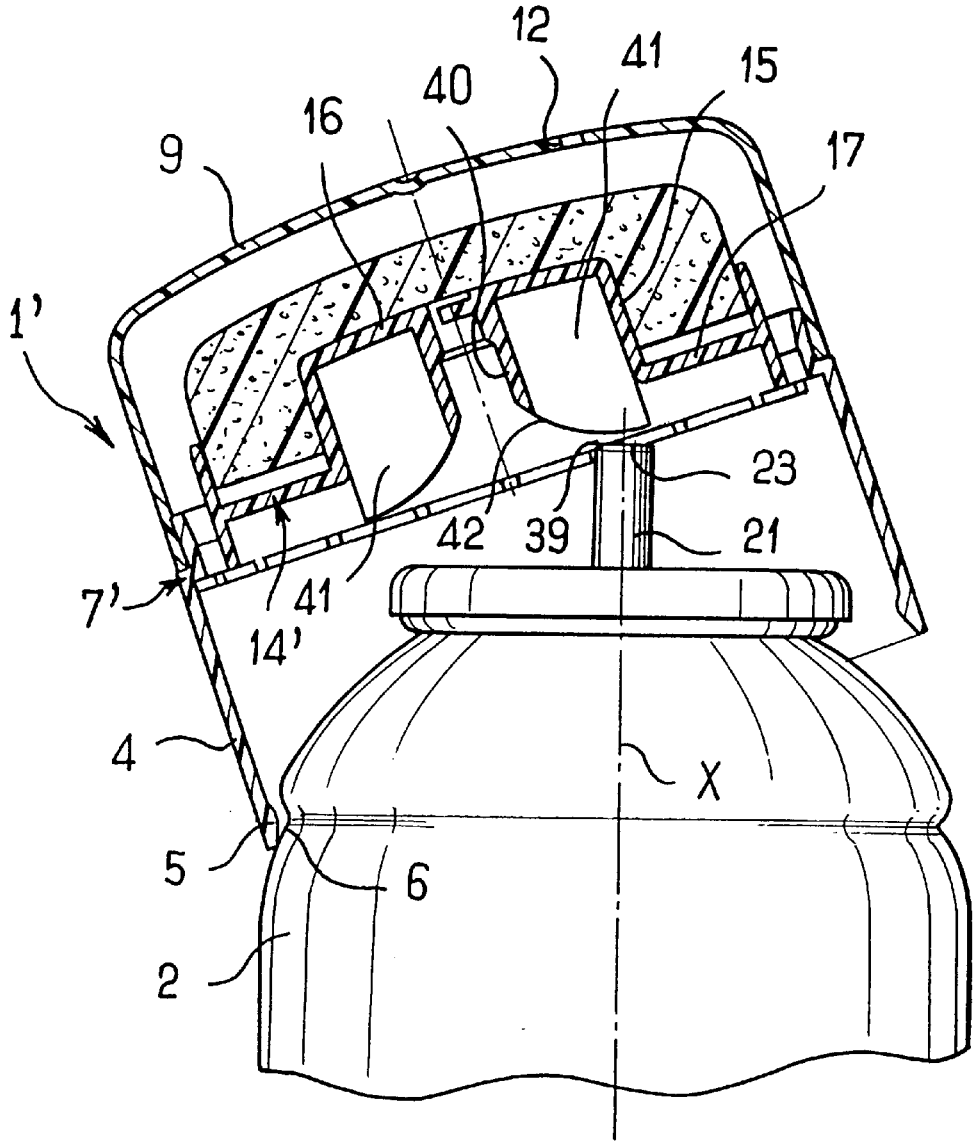
FIGS. 6 to 8 show various relative dispositions of a cover of the invention and of the associated receptacle, during attempts to put the cover into position.
Figure 7:
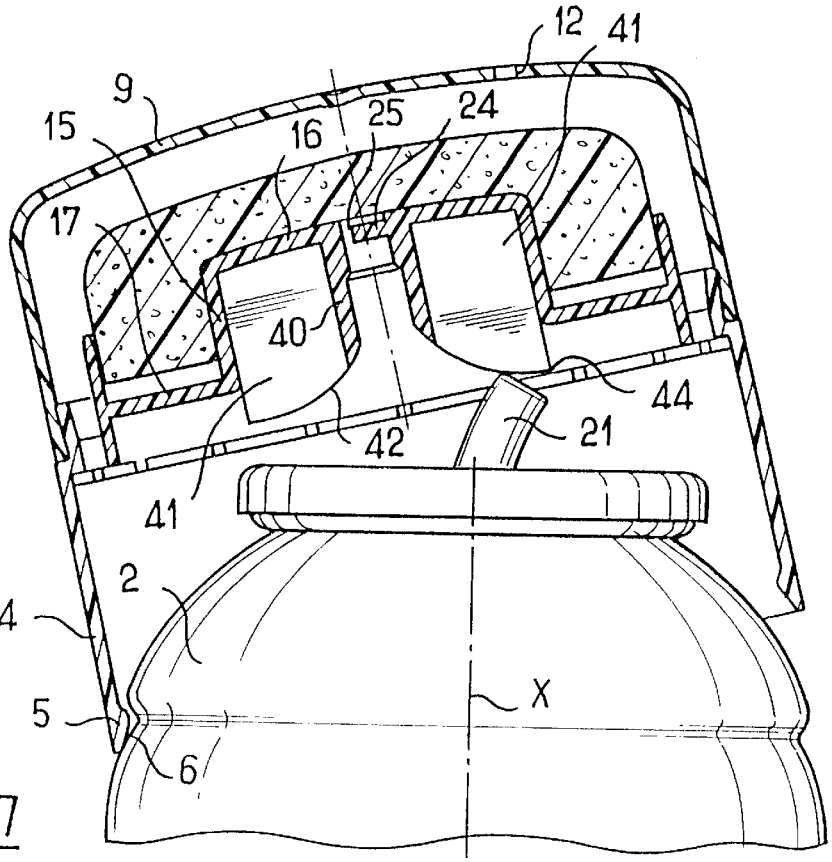
Figure 8:
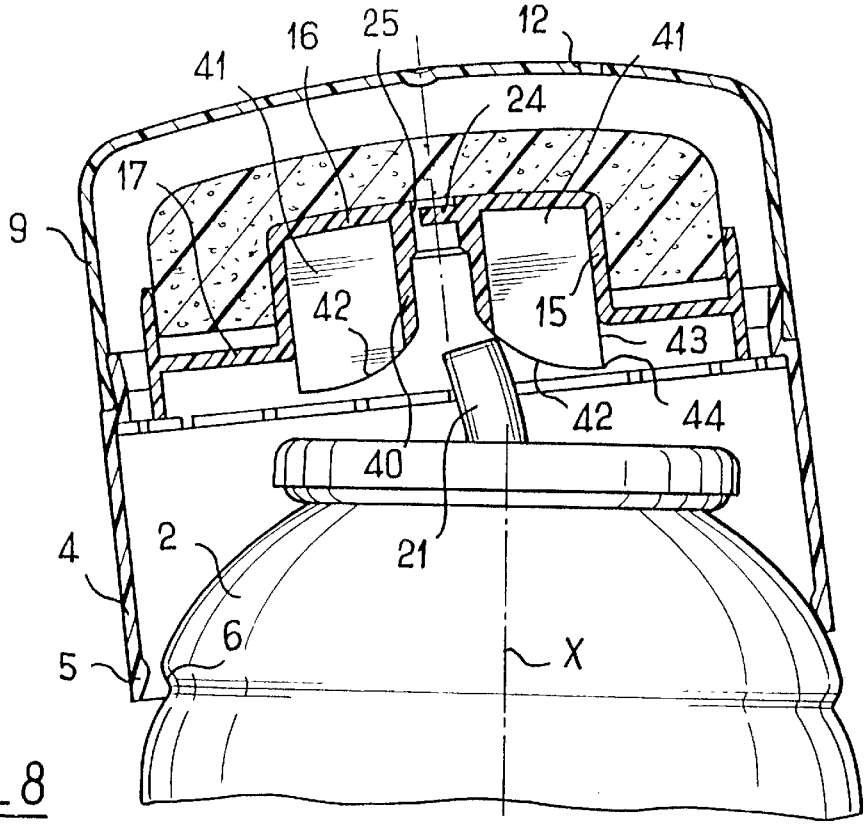

FIGS. 6 to 8 show various relative positions of the cover 3' of the device 1' relative to the receptacle 2. These figures are usefully compared to FIGS. 9 to 11 which show how it is possible to fix a prior art cover with the control rod wrongly positioned, e.g. after the cover has been accidentally detached and is then put back into place on the receptacle by an inexperienced user.

Figure 9:
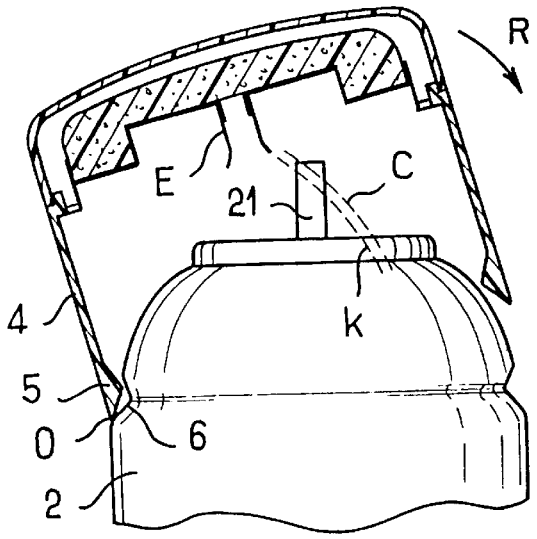
PRIOR ART FIG. 9
FIGS. 9 to 11 show how it is possible to snap into place a conventional cover with the control rod lying outside the endpiece, in the event of the cover being put back into place by an inexperienced user.
Figure 10:
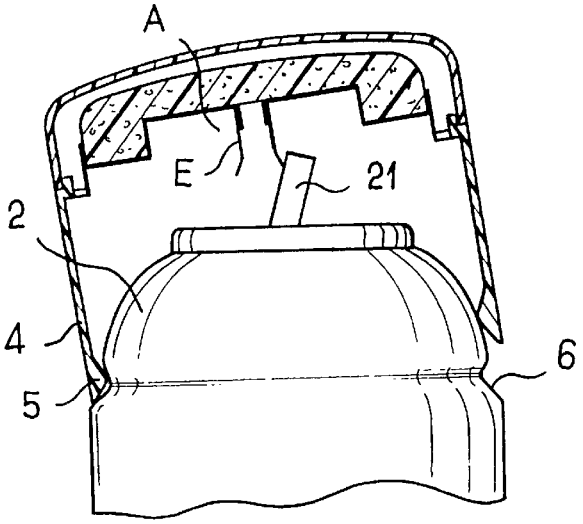
PRIOR ART FIG. 10
Figure 11:
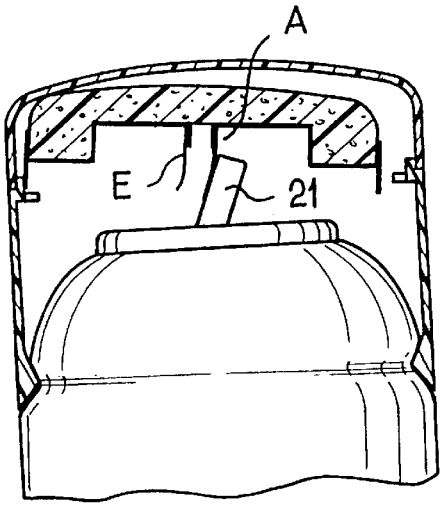
PRIOR ART FIG. 11

The cover may become accidentally detached, for example, if the user attempts to remove the protective lid while the lid is still connected to the cover by a tamper-proofing strip. The invention makes it possible to avoid any risk of the cover being put back into place by the user tilting the cover about an axis of rotation passing through the point of contact between the bottom end of the cover and the annular groove in the receptacle, as shown in FIGS. 9 to 11, with the user, wrongly, believing that tilting the cover in this way will automatically bring the endpiece into position on the control rod. In prior art devices, such an operation leads to the cover being snapped into place with the control rod lying outside the endpiece, since the above-defined circle C is of a radius that is greater than the circle K, such that the endpiece E of the cover comes into abutment against the flank of the control rod 21 and pushes it into an inclined position as shown in FIG. 10. In prior art devices, it is possible for the control rod to gain access to the annular region A around the endpiece E such that if the user applies sufficient force to the cover it is possible to snap the cover into place on the receptacle in spite of the fact that the control rod 21 is not engaged in the endpiece E. However the control rod is then in a position where the valve is open and this leads to the receptacle being emptied.

In contrast, by means of the invention, it is not possible to fix the cover while the control rod is in its inclined, valve-opening position. If an inexperienced user attempts to put the cover 3 back into place by tilting it about an axis of rotation passing through the above-defined point O and perpendicular to the section plane of FIGS. 6 to 8, then the fins 41 prevent the control rod 21 from occupying the annular space formed between the endpiece 40 and the tubular wall 15, and the path followed by the edge 44 that is furthest away from the above-specified axis of rotation does not intersect the flank of the control rod 21, so the control rod always remains oriented in the manner shown in FIG. 6, i.e. in its rest position coaxial with the axis X, in which it presents best resistance against the cover being put back into place.

Nevertheless, if the user does indeed manage to incline the control rod 21 towards the outside, as shown in FIG. 7, when trying to put the cover back into place on the receptacle, the fins 41 occupying the annular space around the endpiece 40 oppose any descent of the cover onto the receptacle and enabling the annular swelling 5 to be snapped into the annular groove 6.

Supposing the user does not try to put the cover back into place by tilting in the manner described above, but instead seeks to engage it by moving it in translation parallel to the axis X, as shown in FIG. 8, then the fins 41 constitute a guide structure facilitating insertion of the control rod 21 into the endpiece.

Finally, by eliminating any risk of the cover being snapped into place with the control rod lying outside the endpiece, the invention makes it possible to benefit both from increased security when assembling the cover on the receptacle and also to increase manufacturing productivity because it provides greater tolerance in the relative positioning of the endpiece and the control rod prior to the cover being snapped into place, without that impeding maneuverability of the applicator for the purpose of actuating the valve.

The use of an additional part 21 as described with reference to FIG. 1 is preferred when it is desired to minimize modifications that need to be made to existing parts and the modes used for manufacturing them.

Naturally, various modifications can be made to the embodiments described above without going beyond the ambit of the present invention.

In particular, the valve may be suitable for being opened by pushing the control rod down.

I claim:

1. A receptacle containing a substance stored under pressure, wherein the receptacle is fitted with a dispenser device for dispensing said substance, the device comprising a cover for snapping onto the receptacle, the receptacle being provided with a valve having a control rod, the cover including a tubular endpiece for engaging on the control rod, and co-operating therewith to form a channel through which the substance can pass, wherein the tubular endpiece defines within said cover an annular space, wherein the cover includes at least one bearing surface disposed outside the endpiece for preventing, in case the control rod is not properly aligned with said tubular endpiece, the control rod occupying the annular space around the endpiece, for preventing the cover from being snapped into place when the control rod is in an inclined position, said control rod having a length such that in the absence of said bearing surface the control rod would be able to occupy the annular space around said endpiece.

2. A receptacle according to claim 1, wherein said bearing surface is implemented by means of a part added to the endpiece for preventing the control rod from occupying the annular region surrounding the outside of the endpiece.

3. A receptacle according to claim 1, wherein the cover includes a plurality of bearing surfaces in the form of fins extending radially outwards from the endpiece.

4. A receptacle according to claim 3, wherein the bottom free edge of each fin is outwardly convex.

5. A receptacle according to claim 1, wherein each bearing surface forms a guide structure for guiding the control rod towards the endpiece.

6. A receptacle according to claim 3, wherein the bottom free edge of each fin is plane.

7. A receptacle according to claim 1, wherein the endpiece is an integral portion of a support portion for an applicator member connected by a flexible link to the remainder of the cover.

8. A receptacle containing a substance stored under pressure, wherein the receptacle is fitted with a dispenser device for dispensing said substance, said receptacle having a dome-shaped top portion, the device comprising a cover for snapping onto an annular groove formed on said dome-shaped top portion of the receptacle, the receptacle having an axis and being provided with a valve having a control rod, the cover including a tubular endpiece for engaging on the control rod, and co-operating therewith to form a channel through which the substance can pass, wherein the tubular endpiece defines within said cover an annular space, wherein the cover includes at least one bearing surface disposed outside the endpiece for preventing, in case the control rod is not properly aligned with said tubular endpiece, the control rod occupying the annular space around the outside of said endpiece whatever the angular position of the cover around the axis of the receptacle in which the cover can be snapped onto the receptacle, for preventing the cover from being snapped into place when the control rod is in an inclined position, said control rod having a length such that in the absence of said bearing surface the control rod would be able to occupy the annular space around said endpiece.

9. A receptacle containing a substance stored under pressure, wherein the receptacle is fitted with a dispenser device for dispensing said substance, the device comprising a cover for snapping onto the receptacle, the receptacle having an axis and being provided with a valve having a control rod, said valve being opened by a lateral thrust on said control rod, the cover including a tubular endpiece for engaging on the control rod, and co-operating therewith to form a channel through which the substance can pass, wherein the tubular endpiece defines within said cover an annular space, wherein the cover includes at least one bearing surface disposed outside the endpiece for preventing, in case the control rod is not properly aligned with said tubular endpiece, the control rod occupying the annular space around the outside of the endpiece whatever the angular position of the cover around the axis of the receptacle in which the cover can be snapped onto the receptacle, for preventing the cover from being snapped into place when the control rod is in an inclined position, said control rod having a length such that in the absence of said bearing surface the control rod would be able to occupy the annular space around said endpiece.

* * * * *